US009970187B2

(12) United States Patent
Cummings et al.

(10) Patent No.: US 9,970,187 B2
(45) Date of Patent: May 15, 2018

(54) RIMLESS TOILET PAN AND A METHOD OF FLUSHING SAME

(71) Applicant: Caroma Industries Limited, Fortitude Valley, Queensland (AU)

(72) Inventors: Stephen John Cummings, Newport (AU); Leonard Conrad, Collaroy (AU); Johann Karunaratne, Allambie Heights (AU); Frank Quartiero, Fortitude Valley (AU)

(73) Assignee: Caroma Industries Limited, Queensland (AU)

( * ) Notice: Subject to any disclaimer, the term of this patent is extended or adjusted under 35 U.S.C. 154(b) by 0 days. days.

(21) Appl. No.: 15/313,429

(22) PCT Filed: May 8, 2015

(86) PCT No.: PCT/AU2015/000269
§ 371 (c)(1),
(2) Date: Nov. 22, 2016

(87) PCT Pub. No.: WO2015/196235
PCT Pub. Date: Dec. 30, 2015

(65) Prior Publication Data

US 2017/0198467 A1 Jul. 13, 2017

(30) Foreign Application Priority Data

Jun. 26, 2014 (AU) ..... 2014902445

(51) Int. Cl.
*E03D 1/24* (2006.01)
*E03D 11/08* (2006.01)

(52) U.S. Cl.
CPC ..... *E03D 11/08* (2013.01); *E03D 2201/40* (2013.01)

(58) Field of Classification Search
CPC ..... E03D 11/08; E03D 2201/40
(Continued)

(56) References Cited

U.S. PATENT DOCUMENTS 5,010,602 A * 4/1991 Sargent ..... E03D 5/01 4/321
6,145,138 A 11/2000 Nakamura et al.
(Continued)

FOREIGN PATENT DOCUMENTS

GB 2045311 A 10/1980
GB 2431937 A 5/2007

*Primary Examiner* — Huyen Le
(74) *Attorney, Agent, or Firm* — Wood, Phillips, Katz, Clark & Mortimer

(57) ABSTRACT

A rimless toilet pan (20) including a forward end (F), a rearward end (R), a pan bowl (28), a flushing outlet (32), a flushing water inlet (30), an inwardly facing first sidewall (34), an inwardly facing second sidewall (37) and a flushing water flow splitter (38). The flushing outlet (32) is in fluid communication with the pan bowl (28). The flushing water inlet (30) is in fluid communication with the pan bowl (28). The inwardly facing first sidewall (34) extends substantially around the top of the pan bowl (28). The substantially horizontal ledge (36) extends substantially around the bottom of the first sidewall (34). The inwardly facing second sidewall (37) extends substantially around the pan bowl (28) under the horizontal ledge (36). The flushing water flow splitter (38) is substantially adjacent a rearward end of the first sidewall (34), is in fluid communication with the flushing water inlet (30) and has a leftwards outlet (38*a*) and a rightwards outlet (38*b*). The flushing water flow balancer (40) is on a frontwards part of the first sidewall (34), includes an inwardly facing projection (40*a/b/c*) extending vertically through at least part of the height of the first
(Continued)

sidewall (34) and is positioned substantially symmetrically in relation to a forward to rearward centerline (42) of the toilet pan (28).

15 Claims, 10 Drawing Sheets

(58) Field of Classification Search
USPC ..... 4/329
See application file for complete search history.

(56) References Cited

U.S. PATENT DOCUMENTS

| | | | | |
|---|---|---|---|---|
| 2006/0005310 | A1 | 1/2006 | Nakamura et al. | |
| 2010/0186158 | A1 | 7/2010 | Morita et al. | |
| 2012/0284910 | A1* | 11/2012 | Shirakawa | E03D 11/08 4/420 |
| 2013/0219605 | A1* | 8/2013 | Grover | E03D 11/08 4/300.3 |
| 2015/0267389 | A1* | 9/2015 | Luettgen | E03D 9/00 4/425 |
| 2016/0222641 | A1* | 8/2016 | Urata | E03D 11/08 |

* cited by examiner

R
38
34
26
36
46

36
34
26
44
F 20
30
R
32
W
28
46
44
F

RIMLESS TOILET PAN AND A METHOD OF FLUSHING SAME

FIELD OF THE INVENTION

The present invention relates to a rimless toilet pan and a method of flushing same.

BACKGROUND OF THE INVENTION

Rimmed and rimless toilet pans are known.

Rimmed toilet pans include a downward rim about the top of the pan bowl that is inwardly spaced from the inner sidewall of the bowl by a gap. During flushing, flushing water is directed along the gap in order to be distributed around the pan bowl. Some consumers dislike rimmed toilet pans as they consider the gap to be difficult to clean/disinfect.

Rimless toilet pans overcome this issue by instead using an open channel or ledge about the top of the pan bowl to direct water around and into the pan bowl. Rimless toilet pans are known with a flow splitter positioned at the rearward end of the pan bowl which splits the flushing water into leftward and rightward streams, which each then respectively travel around the leftward and rightward side of the pan. The leftward and rightward streams collide with each other at or near the frontward end of the pan. In order to concentrate the flushing energy of the colliding flushing water streams into the outlet of the pan bowl, it is desirable for the streams to meet at the front to rear centreline of the pan. However, achieving this in the practice is very difficult. If there is an imbalance in the stream and one stream travels slightly faster than the other, then their collision point can vary away from the pan centreline, causing the flushing energy to be non-optimally directed in relation to the pan outlet.

OBJECT OF THE INVENTION

It is an object of the present invention to substantially overcome or at least ameliorate this disadvantage.

SUMMARY OF INVENTION

Accordingly, in a first aspect, the present invention provides a rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under the horizontal ledge;

a flushing water flow splitter substantially adjacent a rearward end of the first sidewall, the flow splitter in fluid communication with the flushing water inlet and having a leftwards outlet and a rightwards outlet;

a flushing water flow balancer on a frontwards part of the first sidewall, the flow balancer including an inwardly facing projection extending vertically through at least part of the height of the first sidewall and being positioned substantially symmetrically in relation to a forward to rearward centreline of the toilet pan.

The flow balancer preferably includes leftward and rightward angled surfaces which meet at an innermost edge that is substantially aligned with the forward to rearward centreline of the toilet pan. In one form, the edge is a substantially linear, preferably substantially vertical. In another form, the edge is a flat surface, preferably substantially vertical.

The ledge preferably follows the shape of the projection in the region of the flow balancer.

The flow splitter preferably also includes a downwards and inwards directed bottom outlet. The bottom outlet is preferably in the form of a gap between a bottom edge of the flow splitter and an adjacent rear wall of the pan bowl.

Preferably, when viewed from above, and with reference to 12 o'clock (front) and 6 o'clock (rear) being aligned on the centreline, the leftwards outlet and the rightwards outlet are positioned around the sidewall at about 5 o'clock and 7 o'clock respectively. Alternatively, the leftwards outlet and the rightwards outlet are positioned around the sidewall at about 4 o'clock and 8 o'clock respectively. Further alternatively, the leftwards outlet and the rightwards outlet are positioned around the sidewall at about 3 o'clock and 9 o'clock respectively.

In a second aspect, the present invention provides a method of flushing a rimless toilet pan, the method including:

directing flushing water from an inlet to a flow splitter having a leftward and a rightwards outlet;

directing the water from each of the leftwards and the rightwards outlets along left and right inner sidewalls of the toilet pan as a left stream and a right stream respectively;

passing the left stream and the right stream over a flow balancer projection substantially frontward to rearward symmetrically positioned between the left and right side walls, and extending through at least part of the left and right side walls, to direct the left and right streams inwardly and away from the left and right inner sidewalls as a combined stream or jet.

The method preferably includes directing the left stream and the right stream along left and right ledges at a top of the left and right side walls.

The method preferably includes varying the shape of the flow balancer projection to adjust the trajectory and/or dispersion of the combined stream or jet.

BRIEF DESCRIPTION OF DRAWINGS

A preferred embodiment of the invention will now be described, by way of an example only, with reference to the accompanying drawings in which.

DETAILED DESCRIPTION OF PREFERRED EMBODIMENTS

Figure 1:
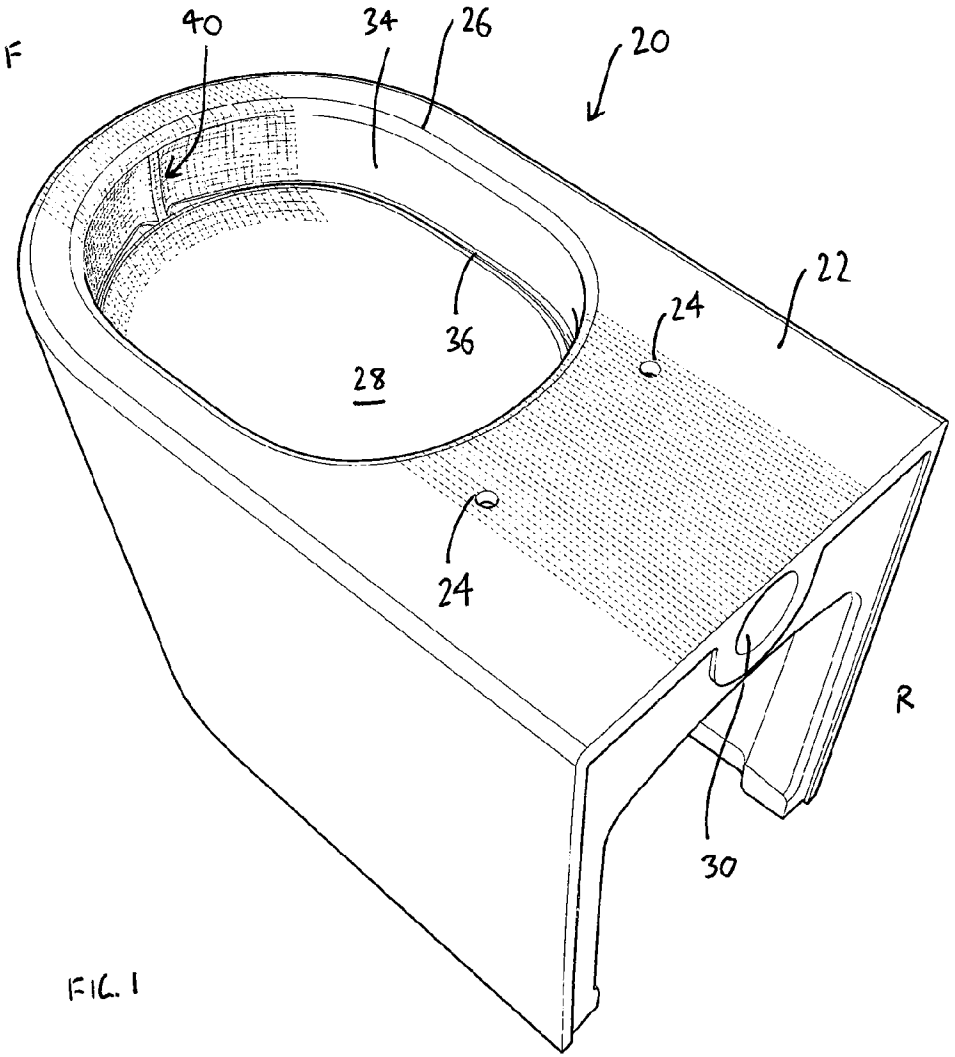
FIG. 1 is a rear perspective view of a first embodiment of a rimless toilet pan.
Figure 2:
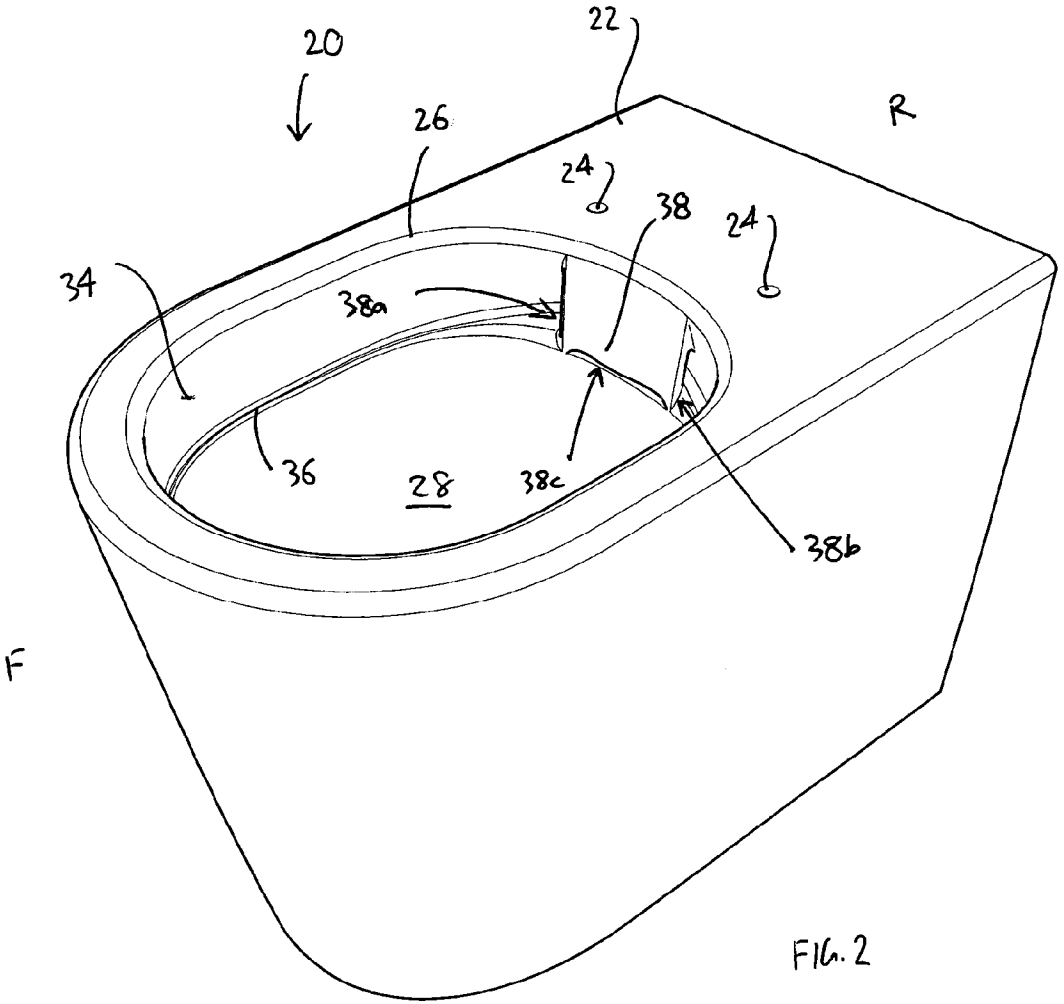
FIG. 2 is a front perspective view of the pan shown in FIG. 1.
Figure 4:
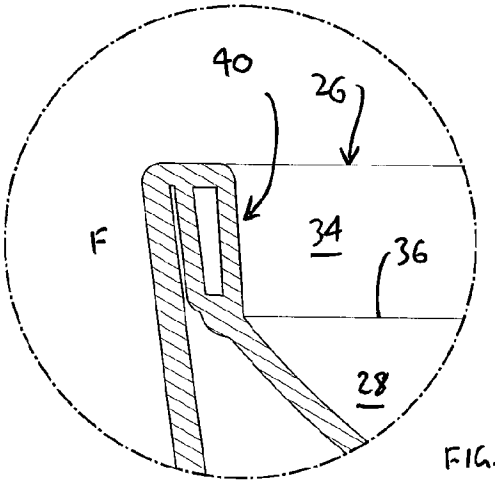
FIG. 4 is an enlarged partial detail view of the pan shown in FIG. 3.

FIGS. 1 and 2 show a first embodiment of a rimless toilet pan 20. The pan 20 is produced from vitreous china but can alternatively be made from plastic or other sanitary ware-suitable materials. The pan 20 has a forward end F and a rearward end R. The pan 20 has a top surface 22 with a pair of holes 24, which are used to fasten a seat and lid (not shown) thereto. The top 22 also includes an opening bounded by a peripheral edge 26 which leads to a pan bowl 28.

A flushing water inlet 30 is located at the rear end R of the pan 20. The flushing water inlet 30 is connected to the outlet of a toilet cistern (not shown) as is well understood by person skilled in the art. In the United States, a cistern is commonly referred to as a flushing tank.

Figure 3:
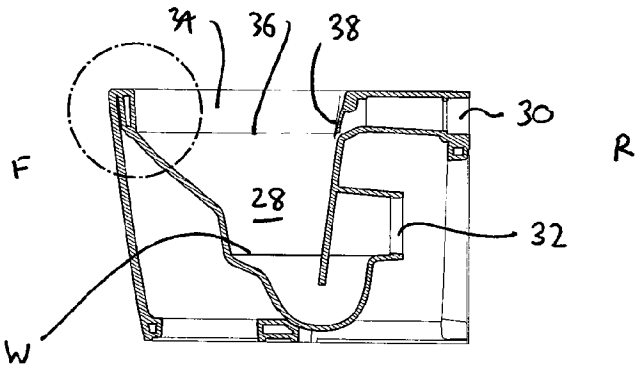
FIG. 3 is a cross sectional side view of the pan shown in FIG. 1.
Figure 10:
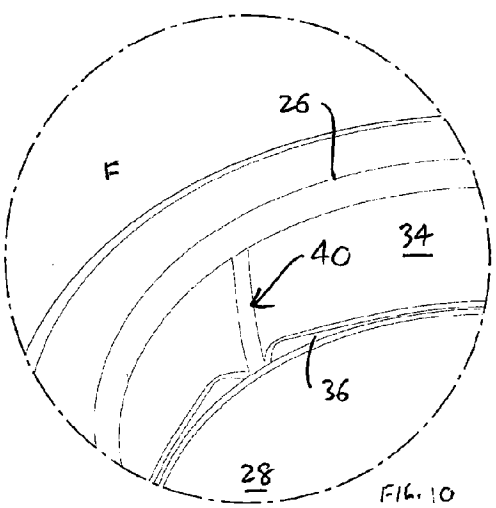
FIG. 10 is an enlarged partial detail view of the pan shown in FIG. 9.
Figure 9:
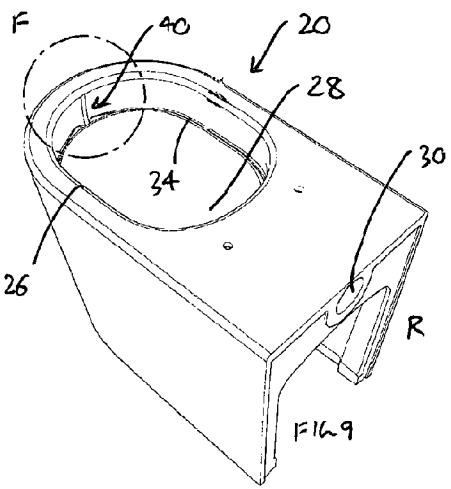
FIG. 9 is a perspective view of the pan shown in FIG. 1.
Figure 8:
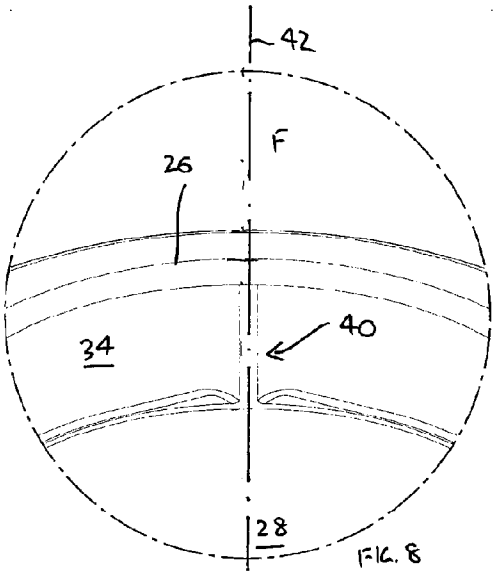
FIG. 8 is an enlarged partial detail view of the pan shown in FIG. 7.
Figure 7:
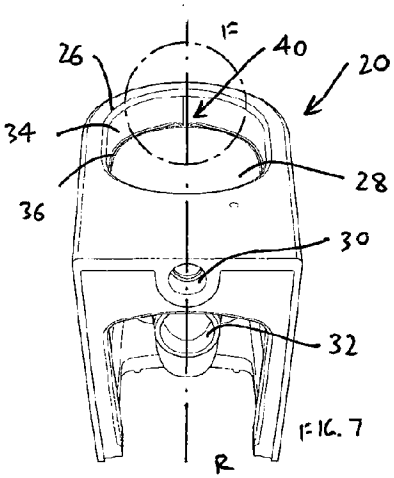
FIG. 7 is a rear view of the pan shown in FIG. 1.
Figure 6:
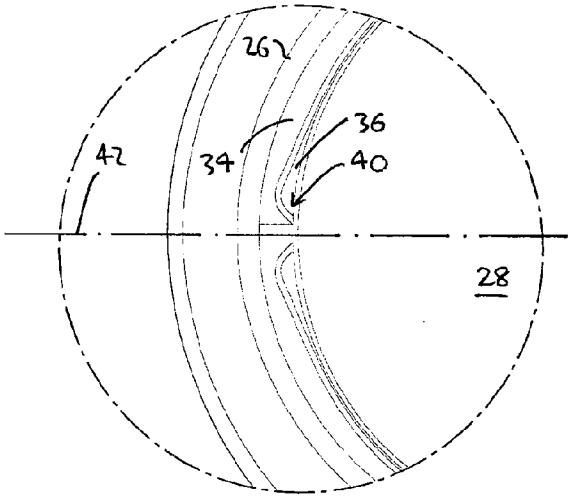
FIG. 6 is an enlarged partial detail view of the pan shown in FIG. 5.
Figure 5:
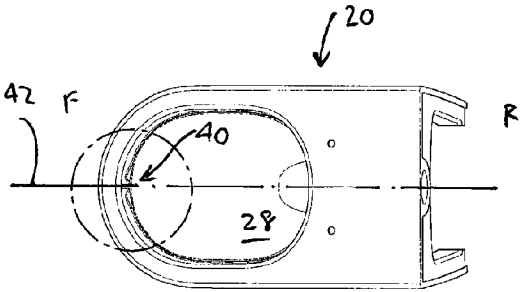
FIG. 5 is a top view of the pan shown in FIG. 1.

As best seen in FIG. 3, the pan 20 also includes a flushing outlet 32 which is connectable to a mains sewer, as is well understood by person skilled in the art. FIG. 3 (and also FIG. 12) shows the pan's trap water level W before flushing.

The pan 20 includes an inwardly facing first sidewall 34, which extends substantially around the top of the pan bowl 28 up to the peripheral edge 26. The pan 20 also includes a substantially horizontal ledge 36, which extends substantially around the bottom of the first sidewall 34. An inwardly facing second sidewall 37 extends substantially around the pan bowl 28 under the ledge 36.

Figures 12, 13, 14:
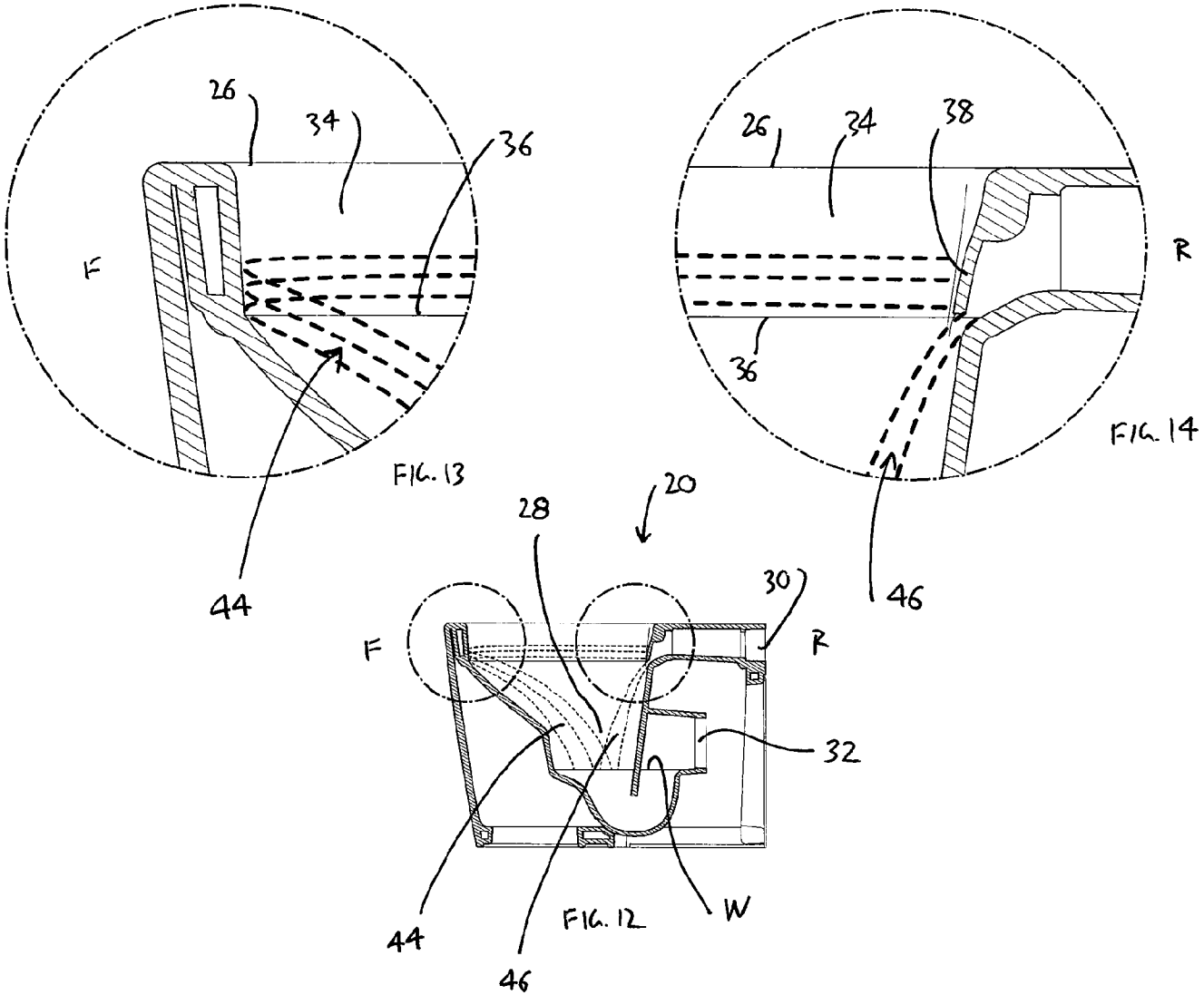
FIG. 12 is a cross sectional side view of the pan shown in FIG. 1 during flushing.
FIG. 13 is a first enlarged partial detail of the pan shown in FIG. 12 during flushing.
FIG. 14 is a second enlarged partial detail view of the pan shown in FIG. 12 during flushing.

As best seen in FIGS. 2 and 3, the pan 20 also includes a flushing water flow splitter 38 which is in fluid communication with the flushing water inlet 30. The flow splitter 38 includes a leftwards outlet 38*a* and a rightwards outlet 38*b*. When viewed from above, and with reference to 12 o'clock (front F) and 6 o'clock (rear R) being aligned on the centreline 42, the leftwards outlet 38*a* and the rightwards outlet 38*b* are positioned around the sidewall at about 5 o'clock and 7 o'clock respectively. The flow splitter 38 also includes a downwards and inwards directed bottom outlet 38*c*, as best shown in FIG. 13. The bottom outlet 38*c* is in the form of a gap between the bottom edge of the flow splitter 38 and the adjacent rear wall of the pan bowl 28.

Figure 11:
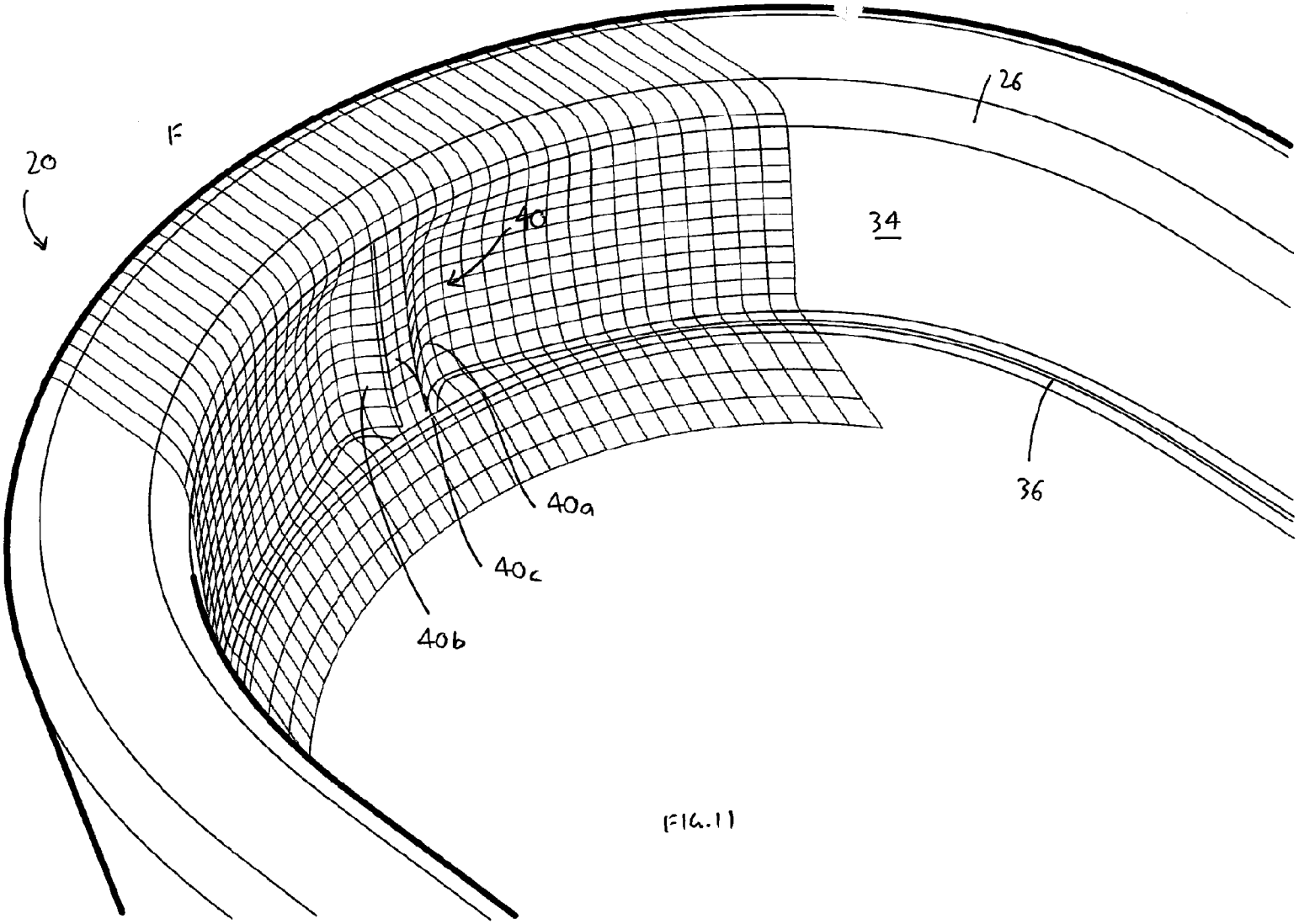
FIG. 11 is an enlarged partial detail rear perspective view of the pan shown in FIG. 1.

As best shown in FIG. 11, the pan 20 includes a flushing water flow balancer, indicated generally by the reference numeral 40, on a frontwards part of the first sidewall 34. The flow balancer 40 includes an inwardly facing projection (see items 40*a*, 40*b*, 40*c* described below) extending vertically through most of the height of the first sidewall 34. The flow balancer 40 is positioned substantially symmetrically in relation to a forward to rearward centreline 42 of the pan 20 (see FIGS. 5 and 6 and FIGS. 7 and 8). The flow balancer 40 includes leftward and rightward inwardly angled surfaces 40*a* and 40*b*, which meet along an innermost edge 40*c* that is substantially aligned with the centreline 42 of the pan 20. The edge 40*c* is in the form of a substantially vertical flat surface. The surfaces 40*a* and 40*b* are slightly outwardly concave. The ledge 36 also follows the shape of the projection 40 in a region 36*a* adjacent to the flow balancer 40. The majority of the sidewall 34 is substantially vertical. However, in the region of the flow balancer 40, the sidewall has a slight downward outward slope. When viewed from above, the flow balancer 40 has a generally triangular cross section, with a truncated edge/surface 40*c*.

The operation of the toilet pan 20 shall now be described.

Referring now to FIG. 12, when a user actuates the cistern to cause flushing of the toilet pan 20, flushing water is communicated from the cistern to the flushing water inlet 30. The flushing water then travels from the inlet 30 to the flow splitter 38, where it is split into leftward and rightward streams. As best shown in FIG. 13, a majority of the leftward and rightward streams flow along and around the first sidewall 34 towards the flow balancer 40. The leftward and rightward angled surfaces 40*a* and 40*b* respectively direct the leftward and rightward streams inwardly and away from the sidewall 34 and cause them to combine in a concentrated flushing stream or jet 44, which is directed substantially rearwardly along the centreline 42 of the pan 20 and downwardly towards the lowermost part of the pan bowl 28. The main purpose of the water stream/jet 44 is to clear the contents of the pan bowl 28 into the pan outlet 32. The flow balancer 40 advantageously effects this flushing action, by controlling the collision of the leftward and rightward flushing streams such that the likelihood of deviation from the centreline 42 of the pan 20 is minimalized. As a result, the accuracy of the rearward and downward direction of the combined streams towards the pan bowl 28 is maximised. Put another way, the flow balancer 40 minimises the likelihood of the combined flushing stream/jet being directed at a side surface of the bowl 28, which would dissipate its flushing energy. This improves the waste clearance of the pan 20 and allows adequate waste clearance of the pan 20 to be maintained whilst reducing the volume of flushing water required. The reduction of water usage has a cost and an environmental benefit. Further, a small proportion of the leftward and rightward streams spills over the ledge 36 and flows down into the pan bowl 28.

As best shown in FIG. 14, a minority of the flushing water exits the flow splitter 38 via the bottom outlet 38*c*, in the form of stream 46. The main purposes of the water stream 46 is to clean the rearward wall surface of the pan bowl 28 and to help push the waste down into the main flushing water stream. In relation to the latter, the water stream 46 reaches the water W and waste before the water stream 44, as the water stream 44 takes longer to travel around the sidewall 34 before being directed into the pan bowl 28. As a result, the stream 46 pushes down and compresses the waste (e.g. toilet paper) before the stream 44 forces the waste through to the outlet 32. This also improves the waste clearance of the pan 20, particularly with reduced (e.g. less than 4 liter) flushing water volumes.

Figure 15:
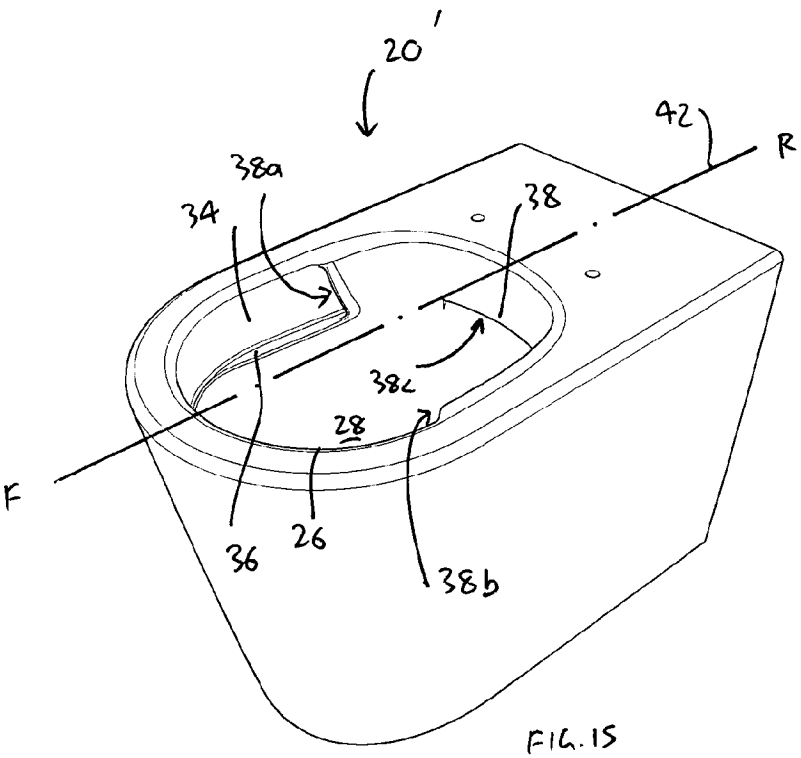
FIG. 15 is a front perspective view of a second embodiment of a rimless toilet pan.
Figure 19:
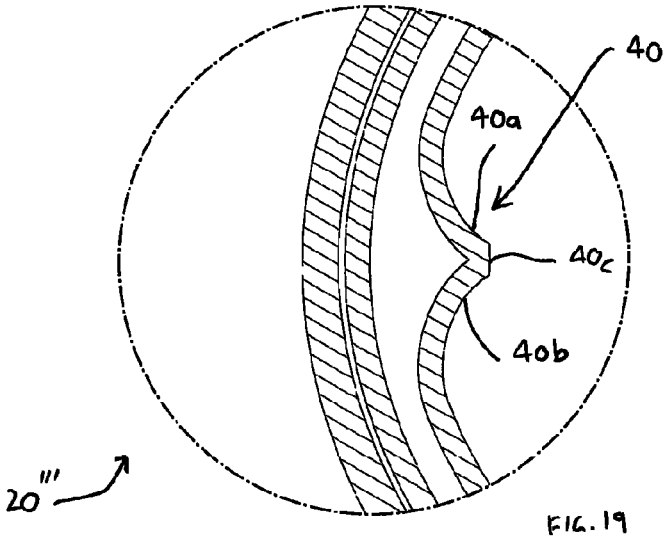
FIG. 19 is an enlarged partial detail view of the pan shown in FIG. 18.
Figure 18:
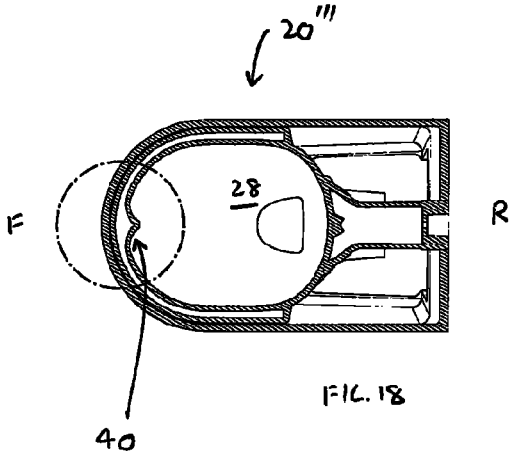
FIG. 18 is a cross sectional view of the pan shown in FIG. 17 along line 18-18.

FIG. 15 shows a second embodiment of a rimless toilet pan 20'. The pan 20' is similar in construction and operation to the pan 20 and like features have been indicated with like reference numerals. However, the leftwards outlet 38*a* and the rightwards outlet 38*b* are positioned around the sidewall at about 4 o'clock and 8 o'clock respectively.

Figure 16:
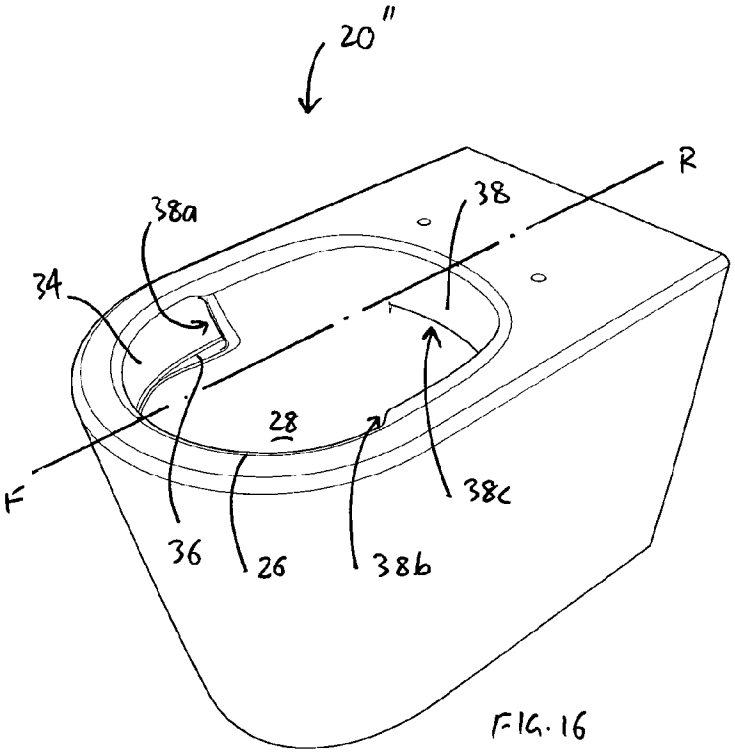
FIG. 16 is a front perspective view of a third embodiment of a rimless toilet pan.

FIG. 16 shows a third embodiment of a rimless toilet pan 20". The pan 20" is similar in construction and operation to the pan 20 and like features have been indicated with like reference numerals. However, the leftwards outlet 38*a* and the rightwards outlet 38*b* are positioned around the sidewall at about 3 o'clock and 9 o'clock respectively.

Figure 17:
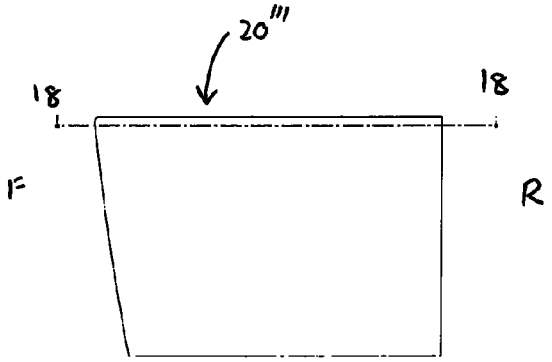
FIG. 17 is a side view of a fourth embodiment of a rimless toilet pan.
Figure 20:
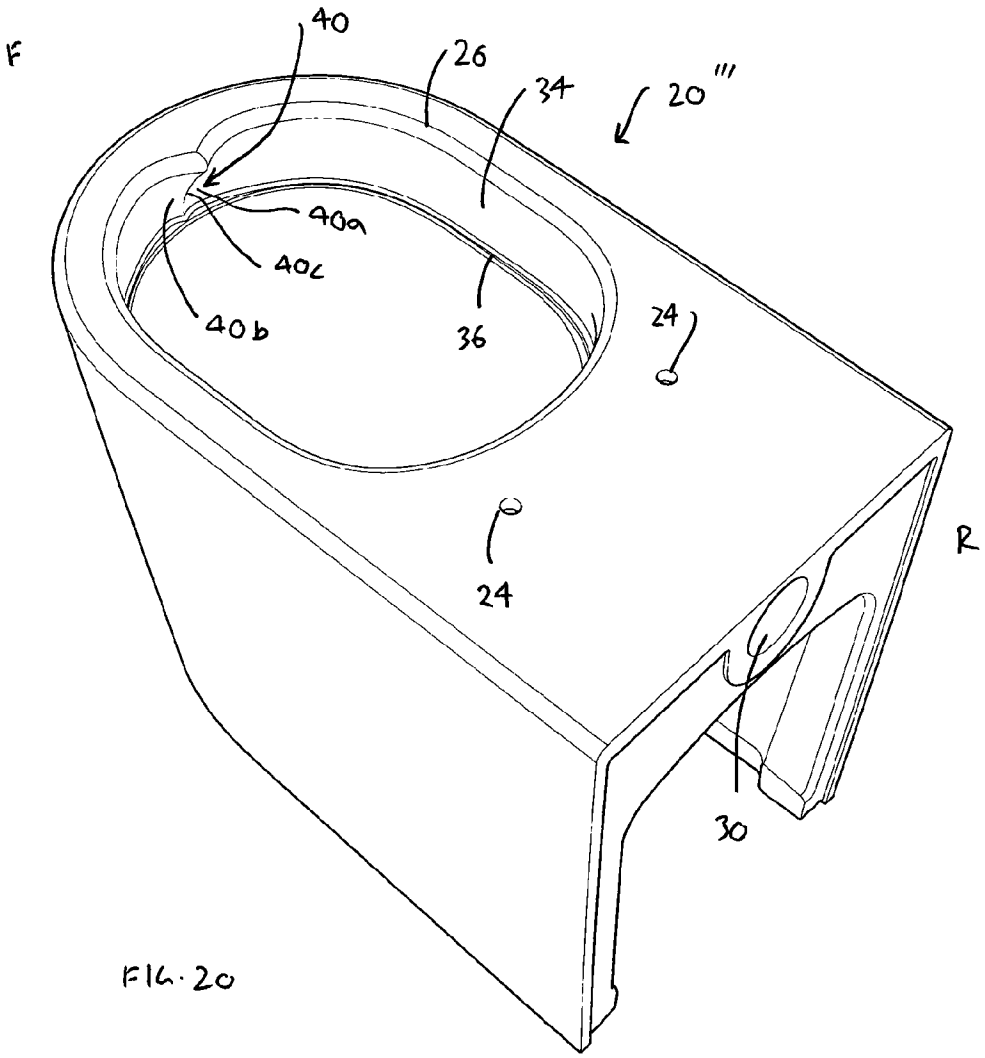
FIG. 20 is a perspective view of the pan shown in FIG. 17.
Figure 22:
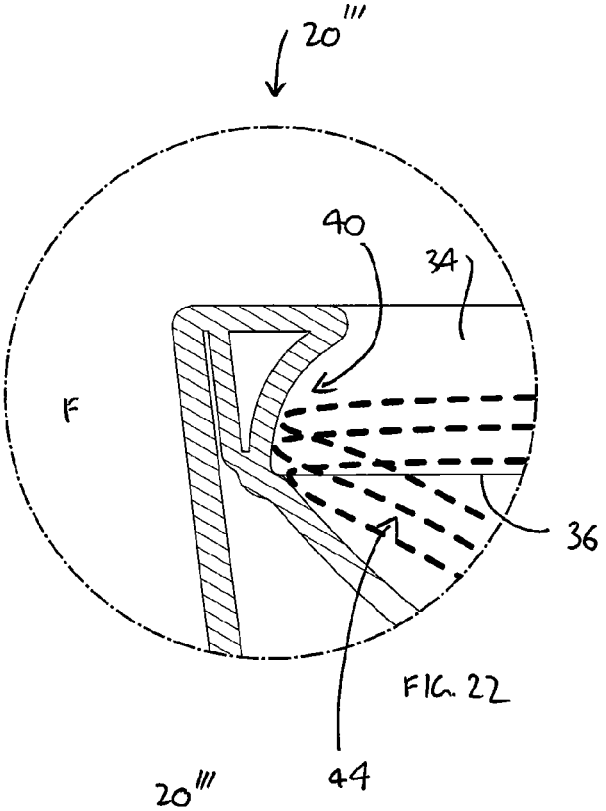
FIG. 22 is an enlarged partial detail view of the pan shown in FIG. 21.

FIG. 17 shows a fourth embodiment of a rimless toilet pan 20'''. The pan 20''' is similar in construction and operation to the pan 20 and like features have been indicated with like reference numerals. However, in the pan 20''', when viewed from the side (see FIGS. 21 and 22), the flow balancer 40 has a much more pronounced downward outward slope. Put another way, the upper part of the flow balancer 40 protrudes inwardly more further than the lower part. The edge 40*c* between the surfaces 40*a* and 40*b* is also linear (not a flat surface).

Figure 21:
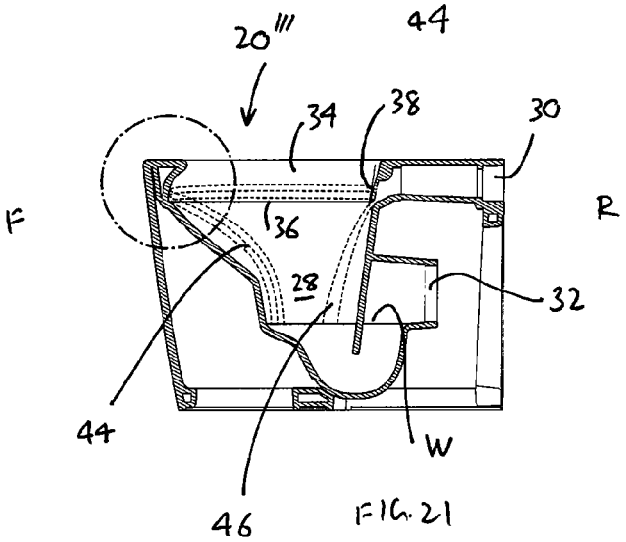
FIG. 21 is a cross sectional side view of the pan shown in FIG. 17 during flushing.

As best shown in FIG. 21, this causes the concentrated flushing stream or jet 44 to be directed more downwardly, than that of the pan 20, resulting in the jet 44 impacting the water surface W in a more forward location. Accordingly, this demonstrates that varying the shape (particularly the profile, shape and angle of the innermost edge 40*c*) of the flow balancer 40 allows the trajectory of the jet 44 to be adjusted, to best suit a particular pan design.

Similarly, the angles of the surfaces 40*a* and 40*b* can be varied to adjust the extent that the jet 44 is dispersed or fanned. When viewed from above, the pan 20 in FIG. 12 has a larger included angle between the surfaces 40*a* and 40*b*, which causes more collision between the leftward and rightward streams and produces a more dispersed stream and the pan 20''' in FIG. 21 has a smaller angle, which results in less collision and produces a more tightly concentrated jet 44.

Although the invention has been described with reference to preferred embodiments, it will be appreciated by person skilled in the art that the invention may be embodied in many other forms. For example, in another embodiment (not shown), the majority of the sidewall 34 is curved or inwardly concave.

The invention claimed is:

1. A rimless toilet pan including:

a forward end;

a rearward end;

a pan bowl;

a flushing outlet in fluid communication with the pan bowl;

a flushing water inlet in fluid communication with the pan bowl;

an inwardly facing first sidewall extending substantially around the top of the pan bowl;

a substantially horizontal ledge extending substantially around the bottom of the first sidewall;

an inwardly facing second sidewall extending substantially around the pan bowl under the horizontal ledge;

a flushing water flow splitter substantially adjacent a rearward end of the first sidewall, the flow splitter in fluid communication with the flushing water inlet and having a leftwards outlet and a rightwards outlet;

a flushing water flow balancer on a frontwards part of the first sidewall, the flow balancer including an inwardly facing projection extending vertically through at least part of the height of the first sidewall and being positioned substantially symmetrically in relation to a forward to rearward centreline of the toilet pan.

2. The rimless toilet pan as claimed in claim 1, wherein the flow balancer includes leftward and rightward angled surfaces which meet at an innermost edge that is substantially aligned with the forward to rearward centreline of the toilet pan.

3. The rimless toilet pan as claimed in claim 2, wherein the edge is a substantially linear.

4. The rimless toilet pan as claimed in claim 3, wherein the edge is substantially vertical.

5. The rimless toilet pan as claimed in claim 2, wherein the edge is a flat surface.

6. The rimless toilet pan as claimed in claim 5, wherein the edge is substantially vertical.

7. The rimless toilet pan as claimed in claim 1, wherein the ledge follows the shape of the projection in the region of the flow balancer.

8. The rimless toilet pan as claimed in claim 1, wherein the flow splitter also includes a downwards and inwards directed bottom outlet.

9. The rimless toilet pan as claimed in claim 8, wherein the bottom outlet is in the form of a gap between a bottom edge of the flow splitter and an adjacent rear wall of the pan bowl.

10. The rimless toilet pan as claimed in claim 1, wherein, when viewed from above, and with reference to 12 o'clock (front) and 6 o'clock (rear) being aligned on the centreline, the leftwards outlet and the rightwards outlet are positioned around the sidewall at about 5 o'clock and 7 o'clock respectively.

11. The rimless toilet pan as claimed in claim 1, wherein, when viewed from above, and with reference to 12 o'clock (front) and 6 o'clock (rear) being aligned on the centreline, the leftwards outlet and the rightwards outlet are positioned around the sidewall at about 4 o'clock and 8 o'clock respectively.

12. The rimless toilet pan as claimed in claim 1, wherein, when viewed from above, and with reference to 12 o'clock (front) and 6 o'clock (rear) being aligned on the centreline, the leftwards outlet and the rightwards outlet are positioned around the sidewall at about 3 o'clock and 9 o'clock respectively.

13. A method of flushing a rimless toilet pan, the method including:

directing flushing water from an inlet to a flow splitter having a leftward and a rightwards outlet;

directing the water from each of the leftwards and the rightwards outlets along left and right inner sidewalls of the toilet pan as a left stream and a right stream respectively;

passing the left stream and the right stream over a flow balancer projection substantially frontward to rearward symmetrically positioned between the left and right side walls, and extending through at least part of the left and right side walls, to direct the left and right streams inwardly and away from the left and right inner sidewalls as a combined stream or jet.

14. The method of flushing a rimless toilet pan as claimed in claim 13, wherein the method includes respectively directing the left stream and the right stream along left and right ledges at a top of the left and right side walls.

15. The method of flushing a rimless toilet pan as claimed in claim 13, wherein the method includes varying the shape of the flow balancer projection to adjust the trajectory and/or dispersion of the combined stream or jet.

* * * * *